US006478723B1

(12) United States Patent
Travers et al.

(10) Patent No.: US 6,478,723 B1
(45) Date of Patent: Nov. 12, 2002

(54) METHOD OF MAKING MULTIPLE SOLICITATION ENVELOPES WITH MATCHING INDICIA

(75) Inventors: Dennis Travers, Green Bay, WI (US); Bruce Liesch, Green Bay, WI (US); Judy Rottier, DePere, WI (US); Dennis Nachtwey, Green Bay, WI (US)

(73) Assignee: Moore USA Inc., Stamford, CT (US)

( * ) Notice: Subject to any disclaimer, the term of this patent is extended or adjusted under 35 U.S.C. 154(b) by 0 days.

(21) Appl. No.: 09/571,658

(22) Filed: May 15, 2000

Related U.S. Application Data

(62) Division of application No. 09/227,541, filed on Jan. 11, 1999.

(51) Int. Cl.[7] ..... B31B 23/00

(52) U.S. Cl. ..... 493/187; 493/194; 493/199; 493/216; 493/220; 493/231; 493/243; 493/264

(58) Field of Search ..... 493/186, 187, 493/194, 199, 231, 243, 216, 220, 264; 283/61, 62, 94, 98, 101

(56) References Cited

U.S. PATENT DOCUMENTS

| | | | | |
|---|---|---|---|---|
| 1,303,968 A | | 5/1919 | Sawdon | |
| 1,385,114 A | | 7/1921 | Cather | |
| 1,516,925 A | | 11/1924 | Lewis et al. | |
| 1,559,132 A | | 10/1925 | Trenchard | |
| 1,667,176 A | | 4/1928 | Torrance | |
| 1,951,287 A | | 3/1934 | Levine | |
| 2,097,916 A | | 11/1937 | Elmore | |
| 2,099,007 A | | 11/1937 | Elmore | |
| 2,207,142 A | | 7/1940 | Berkowitz | |
| 2,312,964 A | | 3/1943 | Dickinson | |
| 2,710,716 A | | 6/1955 | Deutschmeister et al. | |
| 3,665,817 A | * | 5/1972 | Katz et al. | 93/61 R |
| 3,918,632 A | | 11/1975 | Neubauer | |
| 3,952,871 A | | 4/1976 | Erickson | |
| 4,067,171 A | * | 1/1978 | Herbert et al. | 53/31 |
| 4,485,962 A | | 12/1984 | Farley | |
| 4,931,035 A | * | 6/1990 | Schmidt | 493/216 |
| 5,233,812 A | * | 8/1993 | Coppola | 53/411 |
| 5,316,208 A | | 5/1994 | Petkovsek | |
| 5,411,201 A | | 5/1995 | Petkovsek | |
| 5,803,889 A | * | 9/1998 | Littman | 493/267 |
| 5,904,030 A | * | 5/1999 | Kavanagh | 53/460 |
| 5,921,065 A | * | 7/1999 | Slyster et al. | 53/473 |
| 5,938,243 A | * | 8/1999 | De Santo | 283/56 |
| 6,129,265 A | * | 10/2000 | Travers et al. | 229/72 |

* cited by examiner

*Primary Examiner*—Eugene Kim
*Assistant Examiner*—Brian D Nash
(74) *Attorney, Agent, or Firm*—Nixon & Vanderhye P.C.

(57) ABSTRACT

A multiple envelope assembly is made at a common location from a number of different webs of paper using a machine with multiple stations. A first envelope is adhesively secured to a second envelope which has an area at least 10% (preferably at least 20%) greater than the first envelope, and at least one of and preferably both of the outer surfaces of the first and second envelopes have common variable indicia (such as an addressee's name). The common variable indicia is also provided on one or more inserts in each of the first and second envelopes. Addressee indicia is provided on the outer surfaces of at least one of the first and second envelopes. The variable indicia is preferably applied using an ink jet printing assembly, while non-variable multi-color indicia is applied to the envelopes and/or inserts using multi-color flexographic print stations.

18 Claims, 8 Drawing Sheets

METHOD OF MAKING MULTIPLE SOLICITATION ENVELOPES WITH MATCHING INDICIA

This is a division of application Ser. No. 09/227,541, filed Jan. 11, 1999.

BACKGROUND AND SUMMARY OF THE INVENTION

As the use of mass mailings becomes more common, it becomes more important for an entity doing mass mailing to be able to provide a distinctiveness, personalized, mailing piece in order to achieve a high rate of response. Particularly important is the ability to provide variable information of relevance to the recipient of a mailing piece on many, if not all, of the components of the mailing piece, yet do so in an inexpensive manner with a high rate of accuracy and a low reject rate.

According to the present invention a method for producing a distinctive mailing piece is provided in a highly efficient manner that allows variable information—such as the addressee's punctuated full name—on all (if desired) parts of the mail piece. The mail piece according to the invention has a distinctive look, having a larger envelope with a back side flap with a smaller envelope secured (e.g. by hot melt adhesive) to the front of the larger envelope and with the flap of the smaller envelope accessible from the front. The variable information is visible on both of the envelopes, and may include address information (street address, city and state and zipcode, and bar code) as part of the variable information for either one or both of the envelopes. Each of the envelopes has at least one insert, and all or some of the inserts may also have the common variable indicia thereon, providing a very personalized and distinctive mail piece. The envelopes may be made in a very efficient manner using continuous webs of paper, for example the first envelope made by merely folding a web/sheet of paper with adhesive along two sides except at the flap area, and forming the second envelope by joining two webs of paper, with inserts between them and with the first envelope adhesively secured by spot adhesive (in either strip or dot form) to one of the webs, and providing adhesive along the sides and one end edge of the webs with the flap at the other end edge.

According to an aspect of the present invention a method of making a multiple envelope assembly at a common location using a machine with multiple stations, using at least first, second, third, fourth and fifth webs of paper, each having first and second opposite faces, is provided. The method comprises automatically: (a) At a first station effectively imaging non-variable and variable indicia on the first face of the first web of paper, including first variable indicia. (b) At a second station, effectively imaging non-variable and variable indicia on the first face of the second web of paper, including the first variable indicia. (c) Cutting and then folding, or folding and then cutting the first web to form a first insert. (d) Moving the first insert into operative association with the second face of the second web. (e) Applying a first adhesive to part of the second face of the second web. (f) Folding the first sheet so that the first face forms the exterior of a first envelope and the first adhesive seals portions of the second face to each other so that the second face forms the interior of the first envelope, and so that the insert is provided in the interior of the first envelope. (g) Applying a second, spot adhesive to the first envelope. (h) At a third station, imaging non-variable and variable indicia on the first face of the third web of paper, including the first variable indicia. (i) Attaching the first envelope to the first face of the third web using the second, spot, adhesive so that the first variable indicia on each are visible at the same time. (j) At a fourth station, imaging non-variable and variable indicia on the first face of the fourth web of paper, including the first variable indicia. (k) Applying a third adhesive to at least one of the second face of the third web and the second face of the fifth web. (l) Cutting, folding, or folding and cutting the fourth web to form a second insert. (m) Bringing the third and fifth webs together with the second insert therebetween and sealing the second face of the third web to the second face of the fifth web to produce a plurality of pre-second envelopes in web form. And, (n) cutting the third and fifth webs to form each pre-second envelope into a second envelope larger than the first envelope.

The method may be practiced utilizing a sixth web of paper, and further comprising: (o) at a fifth station, imaging non-variable and variable indicia on the first face of the sixth web of paper, including the first variable indicia; and (p) cutting the sixth web to form a third insert; and wherein (m) may be practiced to also provide the third insert between the third and fifth webs. Other inserts can likewise be formed. In the implementation of the method (a), (b), (h) and (j) may be practiced to image addressee name indicia as at least part of the first variable indicia. Also at least one of (b) and (h) may be practiced to also image address indicia as part of the variable indicia imaged thereby, either directly onto an envelope outer surface, or to a label or the like applied thereto.

In practicing (a), (b), (h), and (j), the non-variable indicia may be printed using a multi-color flexographic press assembly, and the first variable indicia printed using an ink jet printer. Further, (a)–(n) may be practiced so as to produce a second envelope having a surface area at least 20% greater than the first envelope, and (f) may be practiced to form a flap; and the method may further comprise applying a fourth, cross strip, of adhesive on the second face of the second web at the flap; and (i) practiced to attach the first envelope to the first face of the third web so that the first envelope flap is visible from the exterior of the second envelope. Also, (n) may be practiced to form a second flap in the third web; and the method may further comprise applying a cross strip of adhesive on the second face of the third web at the flap.

It is the primary object of the present invention to provide a distinctive multiple envelope assembly/mailing piece which may have personalized information (variable indicia) applied to substantially all of the components of the assembly, and can be produced in a relatively simple, fail safe, and inexpensive manner. This and other objects of the invention will become clear from an inspection of the detailed description of the invention and from the appended claims.

DETAILED DESCRIPTION OF THE DRAWINGS

Figure 1:
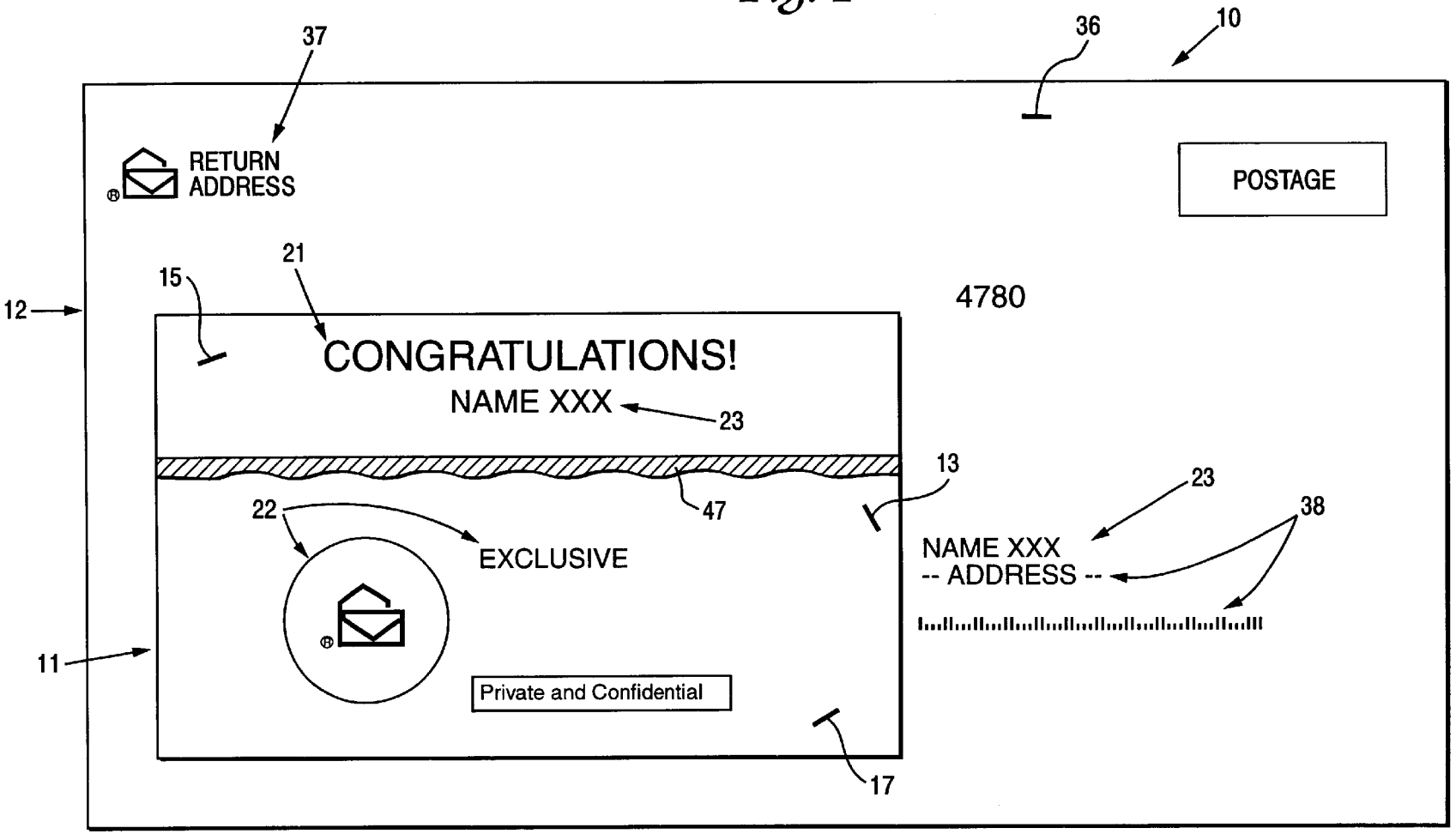
FIG. 1 is a top plan view of a first embodiment of a multiple envelope assembly according to the present invention.
Figure 2:
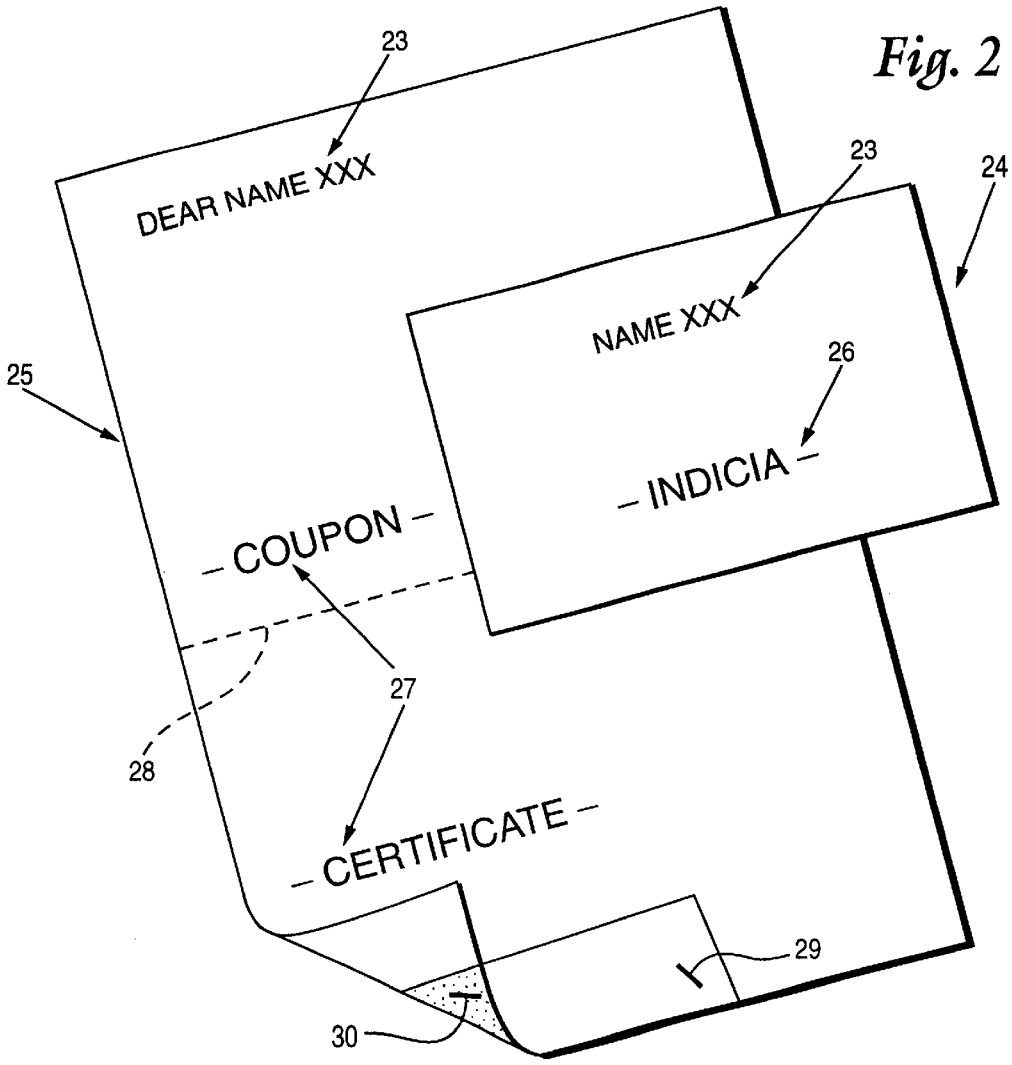
FIG. 2 is a top perspective schematic representation of various inserts that may be provided in the envelopes of the assembly of FIG. 1.
Figure 3:
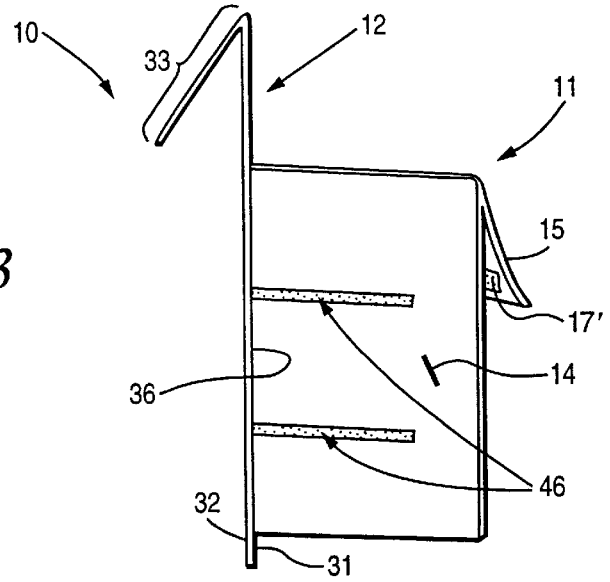
FIG. 3 is a side view of the assembly of FIG. 1 showing the smaller envelope peeled away slightly from the larger envelope to show the adhesive securing them together.
Figure 4:
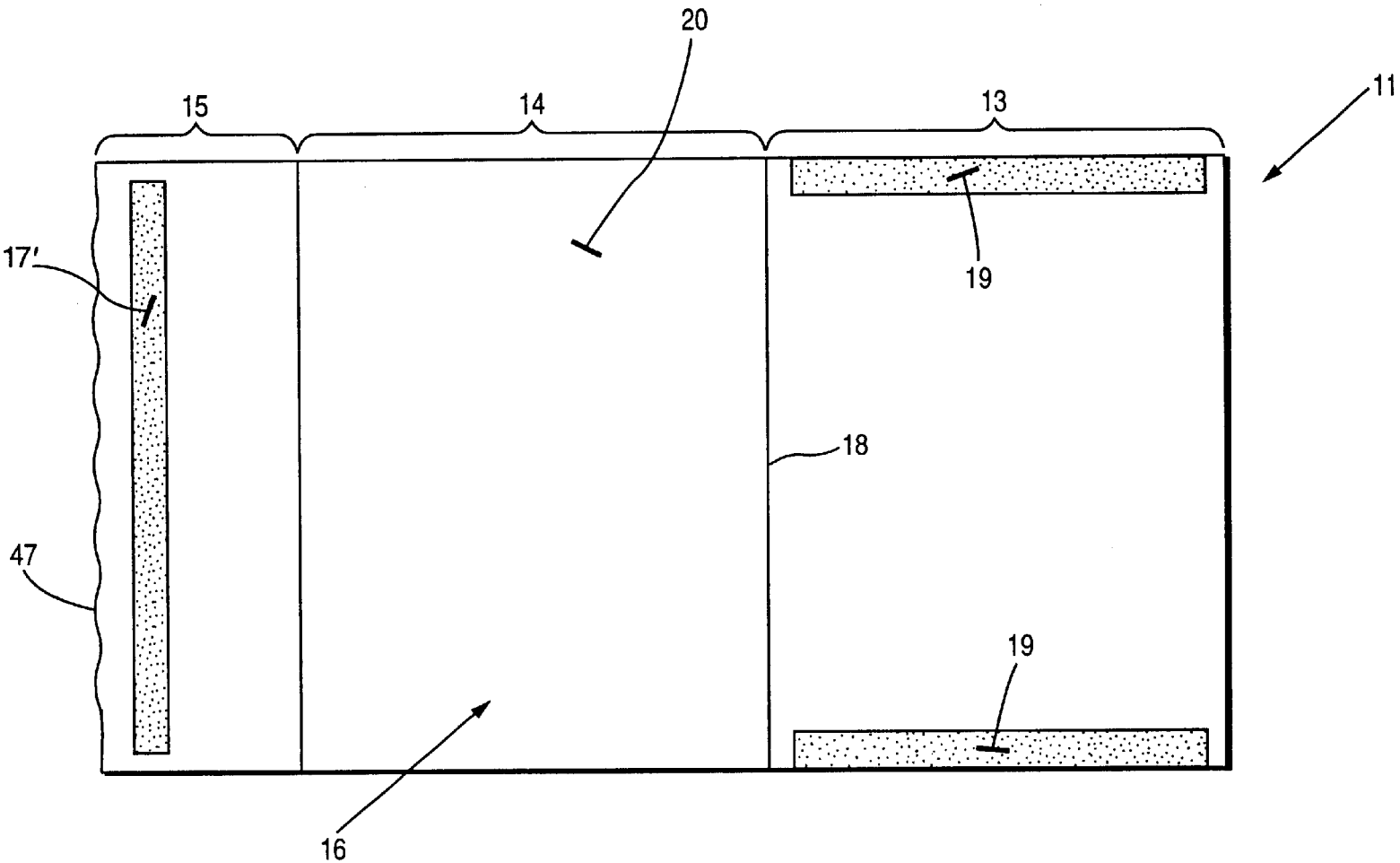
FIG. 4 is a plan view of the smaller envelope of the assembly of FIG. 1 at a stage during manufacture thereof.
Figure 5:
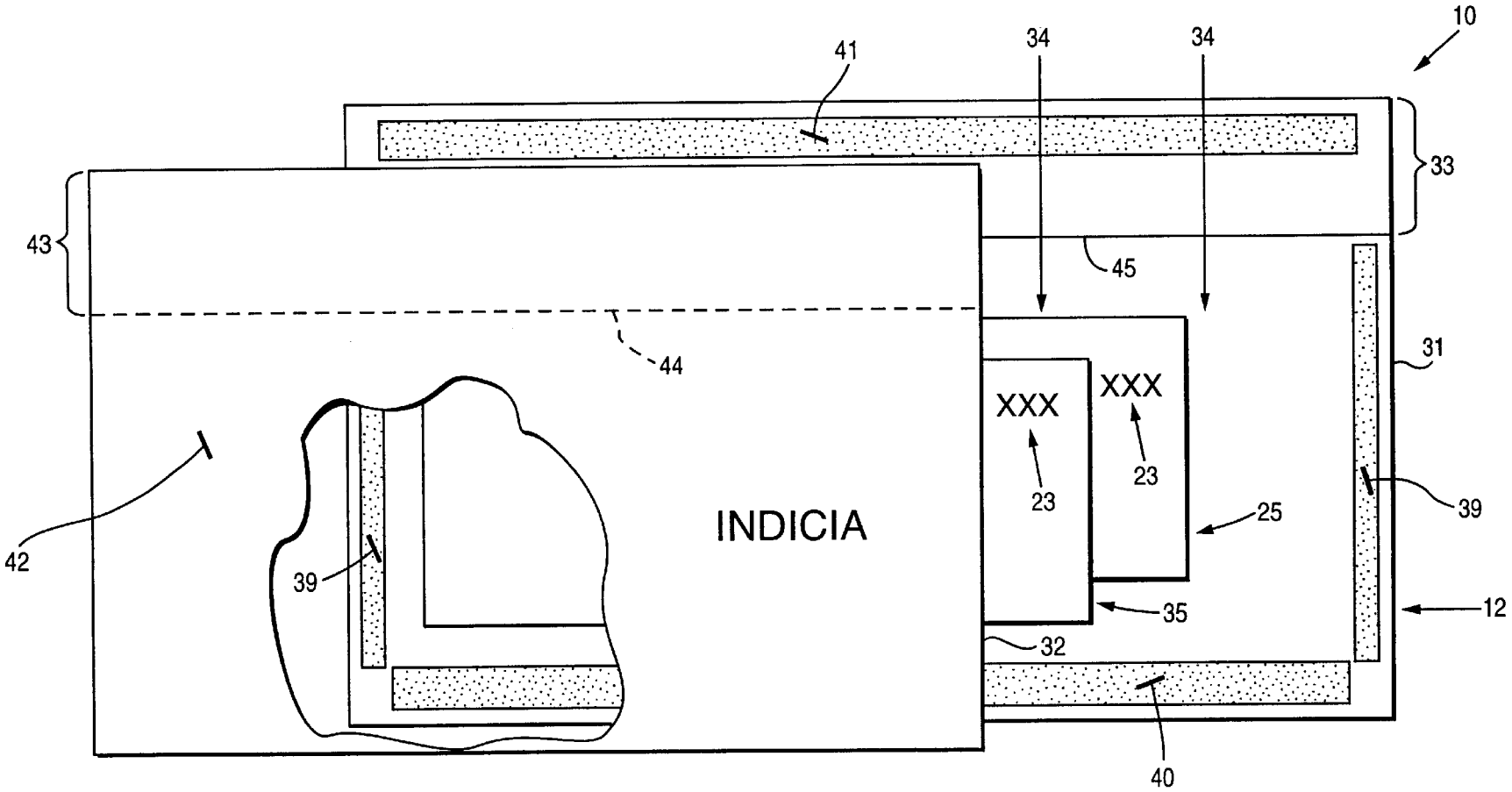
FIG. 5 is a perspective exploded view of the larger envelope of the assembly of FIG. 1 during a stage of manufacture thereof and showing the inserts therebetween and the adhesive holding the plies forming the envelope together.

A first embodiment of an exemplary multiple envelope assembly according to the present invention is illustrated generally by reference numeral 10 in FIGS. 1, 3 and 5, with components thereof illustrated in FIGS. 2 and 4. The assembly 10 comprises a first envelope 11 and a second envelope 12, the second envelope 12 typically having an area at least about 10% greater (preferably at least about 20% greater, and typically being at least about twice as large) as the first envelope 11.

The first envelope 11 has a top ply 13 (see FIGS. 1 and 4 in particular), a bottom ply 14 (see FIGS. 3 and 4), and a flap 15 which seals the top ply 13 to the bottom ply 14, and an opening 16 (see FIG. 4) between the top and bottom plies 13, 14 that is covered by the flap 15. The flap 15 preferably has a pattern (e.g. strip) of adhesive 17' (e.g. rewettable) which adheres to the outer surface 17 (see FIG. 1) of the top ply 13. The bottom ply 14 has a first predetermined area. As seen in FIG. 4 particularly, preferably the first envelope 11 is constructed by folding over a single sheet/web of paper at a fold line 18, with adhesive patterns (e.g. strips) 19 provided along the side edges of the ultimately overlapping portions of one or both of the plies 13, 14 (the strips 19 shown in FIG. 4 as on the ply 13 inner face 20).

The first envelope 11 also includes variable and non-variable indicia operatively imaged on the outer surface 17 (which includes the outer surface of the flap 15 as seen in FIG. 1) thereof, preferably directly imaged thereon, but possibly imaged on a covering label or the like. Exemplary non-variable indicia is shown generally at 21 and 22 in FIG. 1, and may comprise any suitable indicia, and typically is printed with more than one color indicia. Variable indicia 23 is also provided, in the case of FIG. 1 the variable indicia being addressee name indicia (e.g. the punctuated full name of the individual to whom the envelope assembly 10 is directed).

The envelope assembly 10 also comprises inserts, such as the inserts 24, 25 schematically illustrated in FIG. 2. The inserts 24, 25 illustrated there are only exemplary, and many different types—and virtually any number—of inserts may be provided which include all sorts of variations, including adhesive portions, labels, tear off portions, coupons, certificates, letters, prize notifications, or virtually any other type of printed matter. Other inserts besides printed matter may also be provided where desired, but normally all of the inserts are formed by pieces of paper which have been acted upon by equipment to either image indicia thereon, or provide adhesive, tear off strips, or like features.

In the schematic illustration illustrated in FIG. 2, the insert 24—which includes common variable indicia 23 and non-variable indicia 26—may also include other non-variable indicia 27, and may have various features (e.g. perf lines) 28, and/or a removable portion 29 with adhesive (such as rewettable or pressure sensitive adhesive) on the back surface thereof, and the like. The insert 25 is for the second envelope 12. A reply envelope or envelopes, or a reply postcard, may also or alternatively be provided as one or more of the inserts.

Details of the second envelope 12 may be seen with respect to FIGS. 1, 3, and 5. The second envelope 12 comprises plies 31, 32 (see FIGS. 3 and 5) and a flap 33 for sealing the plies 31, 32 together with an open volume—see schematic representation 34 in FIG. 5—therebetween. The open volume 34 is for the receipt of one or more inserts therein—such as the insert 25 seen in FIG. 5, as well as another insert 35, both of the inserts 25, 35 preferably with the common variable indicia 23 thereon. The plies 31, 32 typically have a second area that is at least about 10% greater (preferably at least about 20% greater, and typically about twice as large) as the first area (that of the bottom ply 14 of the first envelope 11).

The second envelope 12 has an outer surface 36 (see FIG. 1), which is the top surface of the first ply 31 which has operatively imaged thereon (either directly, or on a label applied over it) the common variable indicia 23, as well as other indicia, such as the non-variable indicia 37, and other variable indicia 38. In this case the variable indicia 38 is the address (both in human readable and machine readable—e.g. bar code—form) of the addressee (the subject of the common variable indicia 23), such as street address, city and state, zipcode, etc. However other variable indicia may also be provided, and alternatively, or in addition, the variable indicia 38 may be imaged on the surface 17 of the first envelope 11.

In the preferred embodiment illustrated, and visible in FIG. 5, preferably the envelope 12 is constructed by utilizing two separate and distinct paper plies 31, 32 which have adhesive patterns (e.g. strips are illustrated in FIG. 5) which holds the inner surfaces thereof together. In FIG. 5 the adhesive patterns comprise two side strips 39, along the side edges of one or both of the plies' 31, 32 inner faces, and a first end edge pattern 40 again on one or both of the inner surfaces of the plies 31, 32, and opposite the end edge containing the flap 33 (and the opening 34). The flap 33 also has an adhesive pattern (strip) 41 that is substantially parallel to the strip 40, and which seals the outer face (bottom of the envelope 12) 42 of the ply 32. FIG. 5 shows the ply 32 during a stage of manufacture thereof in which a removable flap 43—which subsequently is removed and has dimensions substantially comparable to those of the flap 33—is part of the ply 32, being connected thereto by a line of weakness 44 (e.g. a perforation line, die cut line, or the like). The portion 43 is removed before the flap 33 is folded over, along fold line 45, to close the second envelope 12.

Means are provided for connecting the first envelope 11 to the second envelope 12 so that the outer surfaces 17, 36, respectively, thereof are visible at the same time (as seen in FIG. 1). The connecting means may comprise any suitable known or conventional structure that is capable of performing that function, such as—without limitation—staples, stitching, mechanical crimping or other interaction, etc. However in the preferred embodiment the connecting means comprises adhesive, and most desirably spot adhesive, and still more desirably hot melt spot adhesive. The spot adhesive is shown schematically at 46 in FIG. 3 and may be applied to the outside surface of the bottom ply 14 and/or to the outer surface 36 of the first ply 31 of the second envelope 12, but preferably is applied to the surface 36 though, for clarity of illustration, it is shown applied to the bottom ply 14 of the first envelope 11 in FIG. 3. The spot adhesive may comprise strips—as schematically illustrated in FIG. 3—that are widely spaced, or widely spaced dots, just so the envelopes 11, 12 will be properly held together during typical handling through the mails, but once received by the addressee (for example indicated by the common variable indicia 23) may be detached without destroying either of the envelopes 11, 12.

A wide variety of different adhesives may be used in the manufacture of the envelope assembly 10, depending upon the particular modifications and requirements of the various components. For example, HB Fuller, WB-3142-001 (cold) flexoprint adhesive may be used as the adhesive 46, or alternatively HB Fuller hot melt pressure sensitive adhesive HM 1597 (hot) may be used. Valley adhesive hot melt permanent adhesive HM-130 may be used for the adhesive patterns 19, 39, 40, and rewettable or pressure sensitive adhesive may be used for the adhesive pattern 17, 41 on the flaps 15, 33. A wide variety of other types of adhesives may also be utilized.

The outgoing multiple envelope assembly/mail piece 10 is particularly eye-catching and eminently functional, and therefore likely to result in a relatively high response rate, because of the personalization thereof (in the form of the common variable indicia 23, as well as other variable indicia which may be equally easily applied), and because of the dual envelope configuration as seen clearly in FIG. 1 including with the smaller envelope 11 flap 15 (which may have a scalloped edge 47) readily visible from the outside of the assembly 10, and accessible therefrom. Also the assembly 10 is capable of manufacture (as will be hereinafter described) on a single multi-station piece of equipment simply from webs of paper which are moved together in an intelligent manner (under computer control) so as to properly "marry" all of the components with the common variable indicia 23 thereon.

Figure 6:
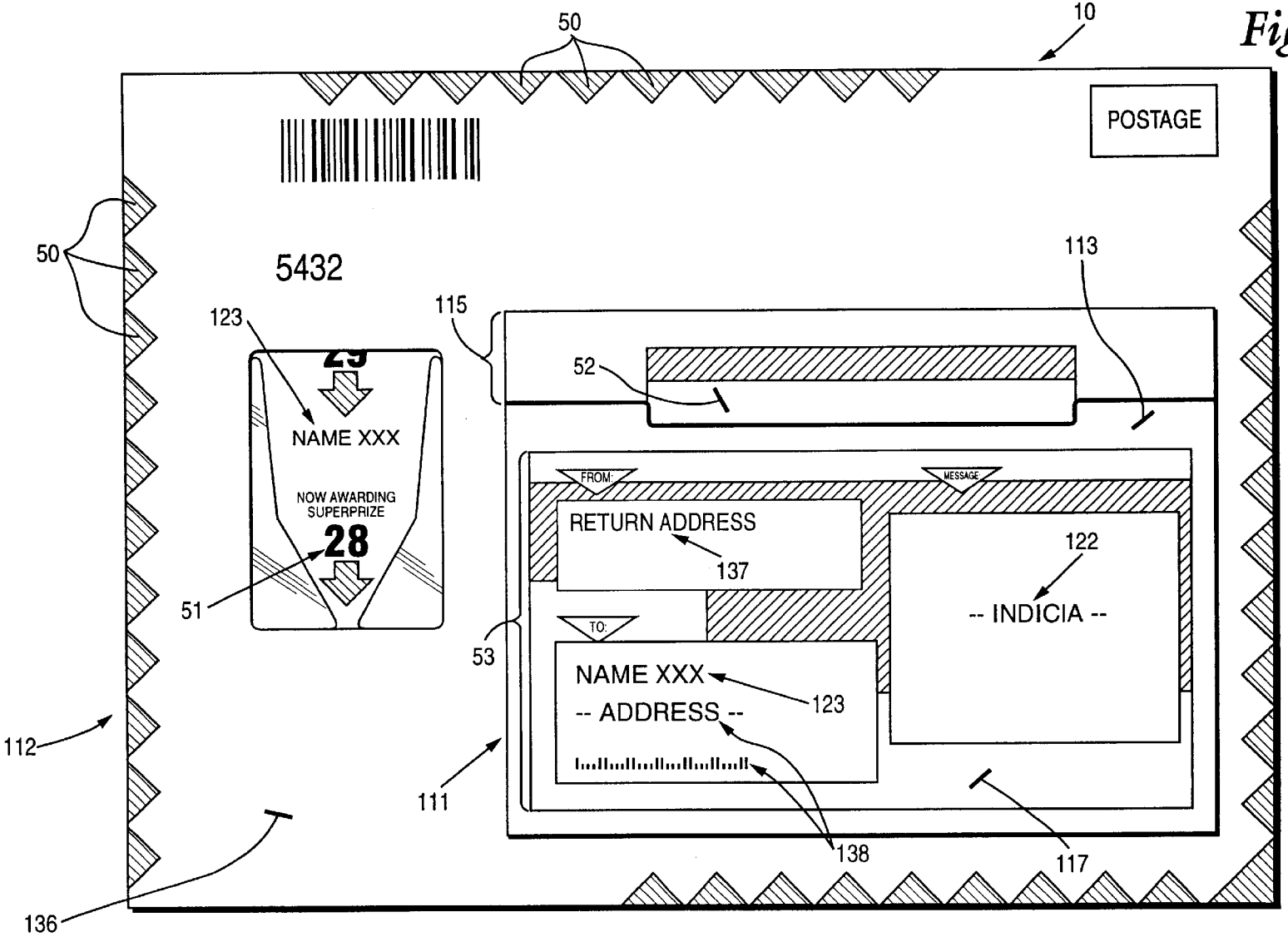
FIGS. 6 through 8 are views like those of FIGS. 1 through 3 for a second embodiment of an envelope assembly according to the invention.
Figure 7:
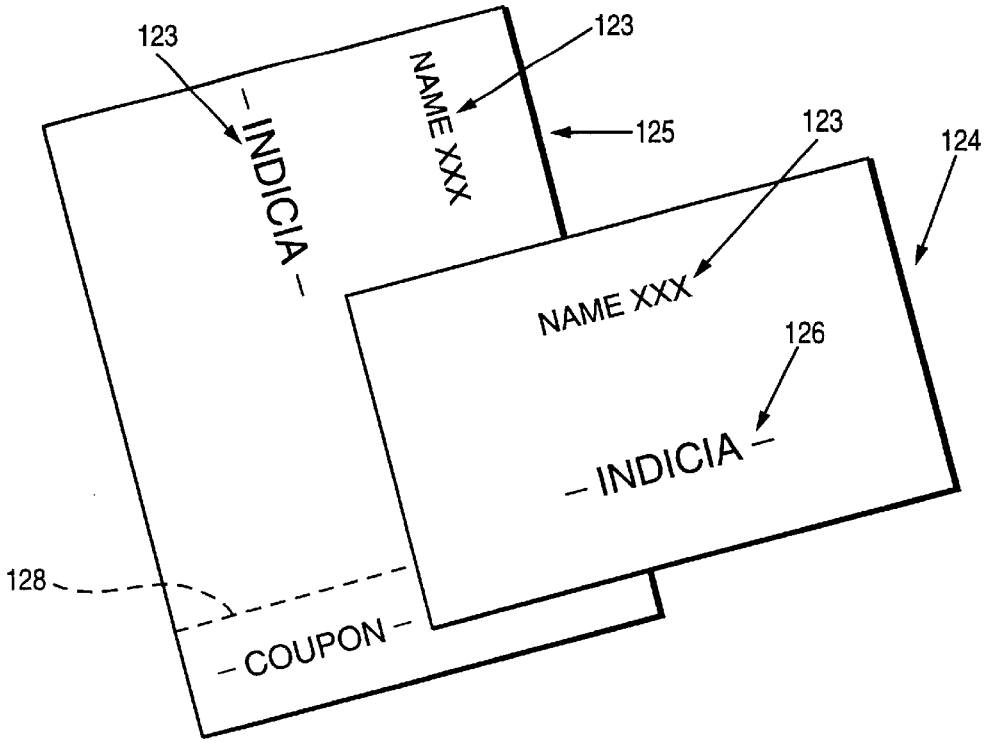
Figure 8:
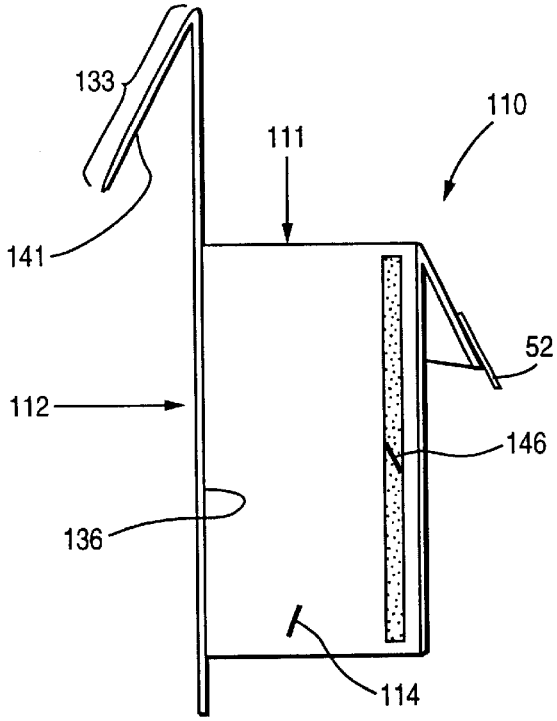

Another embodiment of a multiple envelope assembly according to the present invention is schematically illustrated in FIGS. 6 through 8. In the FIGS. 6 through 8 embodiment components comparable to those in the FIGS. 1 through 5 embodiment are shown by the same reference numeral only preceded by a "1".

The envelope assembly 110 is very similar as far as the major elements of construction are concerned to the assembly 10. Differences most visible are the provision of different styling of the second envelope 112, such as the color triangles 50 imaged along the edges thereof, the provision of a removable "ticket" 51 accessible on the outside of the second envelope 112, the provision of the variable address indicia 138 on the first envelope 111 rather than the second envelope 112, and the use of a "tamperproof" adhesive strip 52 closing the flap 115 to the top ply 113 of the first envelope 111 which may be used in place of or in addition to adhesive like the adhesive 17' on the flap 15. Also in this embodiment the indicia 122, 123, 138 is provided on an actual or pseudo label 53 which is adhesively secured to the top ply 113 and thereby becomes part of the outer surface 117, and the use of a label for this purpose (and/or in association with the second envelope 112) is understood to be within the scope of the claim terminology calling for indicia on the outer surface (117) of the top ply 113 of the first envelope 111. Also in this embodiment the common indicia 123 is not necessarily provided on the outer face 136 of the second envelope 112, although it is provided on one or a plurality of inserts (such as the insert 125) in the second envelope 112.

Figure 9:
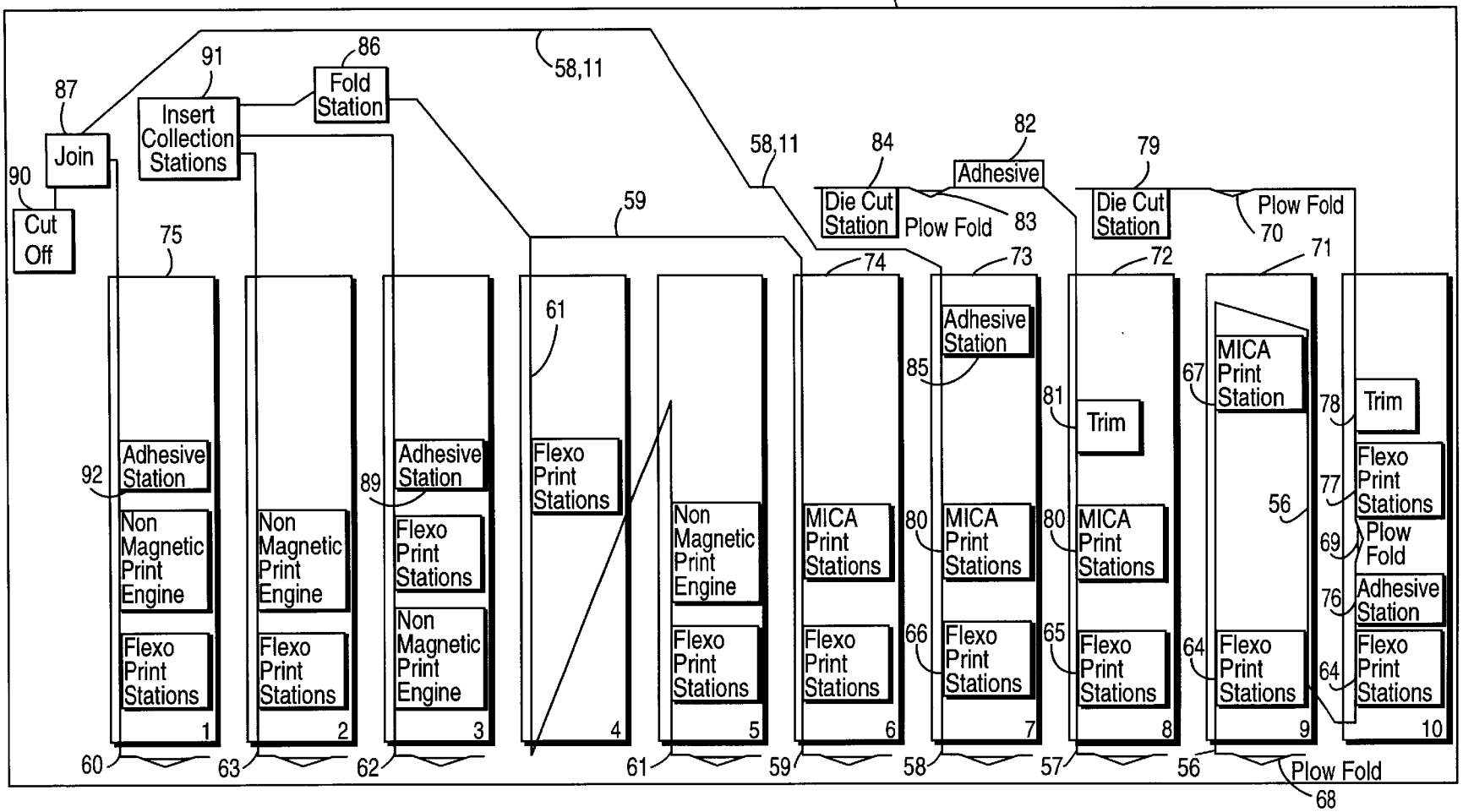
FIG. 9 is a side schematic view of exemplary equipment for the practice of a method according to the present invention for producing the envelope assembly of FIGS. 1 through 5.

FIG. 9 shows an exemplary piece of equipment, generally illustrated by reference numeral 55, for producing the particular envelope assembly 10 according to the present invention. The equipment 55 comprises a plurality of stations, each including modular pieces of equipment, attached to a multi-web press and controlled by a common computer control, particularly a data system used to drive the variable print engines and control the data flow to them such as a Moore XL Data System, available from Moore USA Inc. of Lake Forest, Ill. The equipment 55 is designed to be used with at least first, second, third, fourth, and fifth webs of paper 56–60, respectively, and in the embodiment actually illustrated also uses sixth and seventh webs. In the preferred embodiment of the equipment 55 illustrated in FIG. 9, non-variable indicia is typically printed on the various webs using one of a plurality of multi-color flexographic print stations, such as the station 64 for the first web 56 (another station 64' is also provided for that web) and 65 for the second web 57, 66 for the third web 58, etc. All of the other flexographic print stations illustrated in FIG. 9 are illustrated by a representation similar to that for the stations 64, 64', 65, and 66.

In the equipment 55, the variable indicia is preferably applied using an ink jet print system, such as illustrated schematically by reference numeral 67 for the first web 56 and indicated by the designation "MICA". That is each of the "MICA" units is an ink jet, variable data unit such as that available from Moore USA.

In the illustration in FIG. 9 triangles indicate the position of a turn bar or where a plow fold is taking place, such as for example the turn bar 68 for the first web 56, and the plow fold 69 and another plow fold 70 for that same web 56.

For the particular embodiment illustrated in FIG. 9, at least a first station 71, second station 72, a third station 73, a fourth station 74, and a fifth station 75, are provided. At the first station 71 the first web 56 is acted upon to image variable indicia—at 67—and non-variable indicia—at 64 and 64'—on at least the first face thereof, including first (common) variable indicia 23. Then the first web 56 can have other manipulations performed thereon, and one of the elements of flexographic press 64 may print UV varnish or the like on the first web 56, if desired. For example a conventional adhesive application station 76 is provided for applying a pressure sensitive adhesive to part of the web 56 so that a label portion will be formed. Portions of web 56 may be die cut away at a conventional die cut station 77, and conventional trimming action may occur at portion 78. Ultimately the web 56 is folded and/or die cut, as indicated by fold 70 and by die cut equipment 79—to form a first insert 24 which is moved by the rollers associated with the conventional die cut equipment 79 into operative association with the second face of the second web 57.

The second web 57 at the second station 72 has non-variable information imaged on the first face thereof by the multi-colored flexographic print unit 65, and then variable indicia—including common indicia 23—by the ink jet print station 80. At location 81 the web 57 is trimmed across the web, and then passes up above the station 72 to receive the insert 24 thereon, then passes over the location 82 where the adhesive strips 19 (see FIG. 4), and perhaps the adhesive strip 17' (if not applied elsewhere, such as at the same time as the across the web trim at 81), are applied. The web 57 is then folded at 83, and die cut at 84 to form the first envelope 11.

In the meantime, third web 58—which ultimately forms the first ply 31 of the second envelope 12—has non-variable indicia applied by the color flexographic print unit 66, and variable information, including in this case both the common variable information 23 and the address information 38, by the ink jet unit 80', and then passes to a spot adhesive location 85 where the hot melt adhesive 46 is applied to the first face 36 thereof (the adhesive 46 is seen on the back face 14 of the first envelope 11 in FIG. 3 only for clarity of illustration). Then at and adjacent the die cut location 84, the completed first envelope 11 is attached to the first face 36 of the third web 58 using the adhesive 46 applied at 85 so that the common variable indicia 23 on the faces 17, 36 (see FIG. 1) is visible at the same time. The third web 58, still in web form, but with the first envelope 11 "married" thereto, then passes above the equipment 55 to the far left end thereof, as seen in FIG. 9 where it is ultimately combined with the second ply 32 of the second envelope 12.

The fourth web 59 is imaged, in the same manner as the other webs, to provide appropriate indicia thereon including the common indicia 23, to produce the insert 25 which remains in web form until cut and/or folded at 86, 87 and inserted between the fifth web 60 and the third web 58. Other webs 61 through 63 can also be used to create other inserts, and utilizing any appropriate equipment for that purpose, including a non-magnetic print engine (e.g. a MIDAX print engine available from Moore USA Inc. of Lake Forest, Ill.) 88, various adhesive application stations as indicated schematically at 89, and appropriate trim, perf, or fold equipment. In the embodiment illustrated in FIG. 9, only non-variable indicia is applied to the webs 62 and 63, although variable indicia could also be provided if desired.

The fifth web 60, after imaging at 75 (in this case only non-variable indicia is imaged thereon, such as indicia indicated on surface 42 in FIG. 5, although if desired variable indicia can also be applied thereto) is passed to a position to be joined with the third web 58 to form the second envelope 12.

Just downstream of or at the station 87 in FIG. 9, the third and fifth webs 58 and 60 are brought together with the second insert 25 (web 59) therebetween, and the second face of the third web and the second face of the fifth web are sealed together (see FIG. 5) to produce a plurality of pre-second envelopes, and then the third and fifth webs are cut, as indicated at 90 in FIG. 9 to form the second envelopes 12, cutting taking place adjacent the edge having the adhesive 40, and also to remove the strip 43. Downstream equipment (not shown) may be provided to fold the flap 33 so that the adhesive 41 comes into contact with the surface 42 (see FIG. 5) to produce the final product 10.

While a wide variety of different types and weights of paper may be provided for the webs 56–63, in the particular embodiment illustrated in FIG. 9, the first web 56 is a 24 lb. white flexo fold paper, while the other webs 57–63 are 60 lb. white paper, or some of them may be colored papers or screen printed to have a non-white color. All of the inserts for the second envelope 12 are collected and ultimately fed in to the open area 34 between the webs 58, 60 at the insert collection station 91 in FIG. 9. The adhesive 39, 40 for holding the plies 31, 32 together is applied at station 92. Note that in FIG. 5 the adhesive 39, 40 is shown applied to the ply 31 only for clarity of illustration, but when utilizing the equipment 55 the adhesive is actually applied to the inner face of the ply 32.

Figure 10:
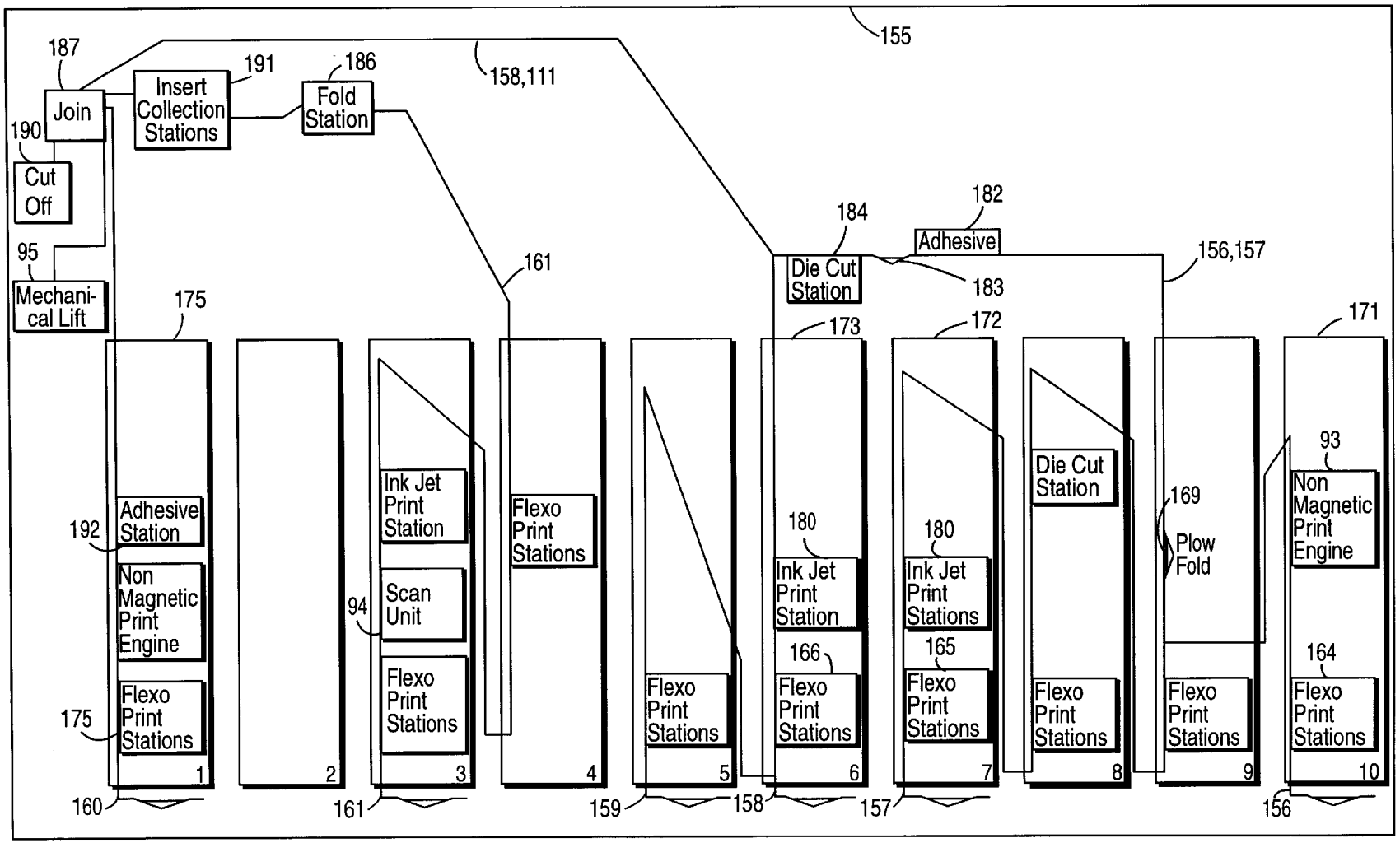
FIG. 10 is comparable to FIG. 9 only for equipment producing the envelope assembly of FIGS. 6 through 8.

FIG. 10 shows basically the same equipment as in FIG. 9 only some of the stations are not utilized, and different modules are provided in some locations (such as a non-magnetic print engine 93 in FIG. 10 instead of pressure sensitive adhesive applicator 76 of FIG. 9). In the FIG. 10 embodiment components comparable to those in the FIG. 9 embodiment are shown by the same reference numeral only preceded by a "1". The equipment of FIG. 10 makes the multiple envelope assembly 110 by using less of the stations, employs a scan unit 94, which scans for register marks, associated with the ink jet printer for the web 161, and uses a safety mechanical lift unit 95. Despite repositioning of some of the components, the machinery 155 performs the same basic functions as the machinery 55. The details of the operation thereof may readily be determined by relating back the reference numerals in FIG. 10 (without the "1") to the corresponding description of FIG. 9.

It will thus be seen that according to the present invention a very distinctive, yet relatively easily constructed, and relatively inexpensive, multiple envelope assembly is provided, as well as an automatic method of making such assemblies at a common location using a machine with multiple sections, simply from webs of paper. While the invention has been herein shown and described in what presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method of making a multiple envelope assembly at a common location using a machine with multiple stations, using at least first, second, third, fourth and fifth webs of paper, each having first and second opposite faces, comprising automatically:

(a) at a first station effectively imaging non-variable and variable indicia on the first face of the first web of paper, including first variable indicia;

(b) at a second station, effectively imaging non-variable and variable indicia on the first face of the second web of paper, including the first variable indicia;

(c) cutting and then folding, or folding and then cutting, the first web to form a first insert;

(d) moving the first insert into operative association with the second face of the second web;

(e) applying a first adhesive to part of the second face of the second web;

(f) folding the first sheet so that the first face forms the exterior of a first envelope and the first adhesive seals portions of the second face to each other so that the second face forms the interior of the first envelope, and so that the insert is provided in the interior of the first envelope;

(g) applying a second spot, adhesive to the first envelope;

(h) at a third station, operatively imaging non-variable and variable indicia on the first face of the third web of paper, including the first variable indicia;

(i) attaching the first envelope to the first face of the third web using the second, spot adhesive so that the first variable indicia on each are visible at the same time;

(j) at a fourth station, imaging non-variable and variable indicia on the first face of the fourth web of paper, including the first variable indicia;

(k) applying a third adhesive to at least one of the second face of the third web and the second face of the fifth web;

(l) cutting and then folding, or folding and then cutting the fourth web to form a second insert;

(m) bringing the third and fifth webs together with the second insert therebetween and sealing the second face of the third web to the second face of the fifth web to produce a plurality of pre-second envelopes in web form; and (n) cutting the third and fifth webs to form each pre-second envelope into a second envelope larger than the first envelope.

2. A method as recited in claim 1 utilizing a sixth web of paper, and further comprising: (o) at a fifth station, imaging non-variable and variable indicia on the first face of the sixth web of paper, including the first variable indicia; and (p) cutting the sixth web to form a third insert; and wherein (m) is practiced to also provide the third insert between the third and fifth webs.

3. A method as recited in claim 2 wherein in practicing (a), (b), (h), and (j), the non-variable indicia is printed using a multi-color flexographic press assembly, and the first variable indicia is practiced using an ink jet printer.

4. A method as recited in claim 2 wherein (a)–(n) are practiced so as to produce a second envelope having a surface area at least 20% greater than the first envelope.

5. A method as recited in claim 2 wherein (f) is practiced to form a flap; and further comprising applying a fourth, cross strip, of adhesive on the second face of the second web at the flap; and wherein (i) is practiced to attach the first envelope to the first face of the third web so that the first envelope flap is visible from the exterior of the second envelope.

6. A method as recited in claim 2 wherein (a), (b), (h) and (j) are practiced to image addressee name indicia as at least part of the first variable indicia.

7. A method as recited in claim 6 wherein at least one of (b) and (h) is practiced to also image address indicia as part of the variable indicia imaged thereby.

8. A method as recited in claim 1 wherein (a), (b), (h) and (j) are practiced to image addressee name indicia as at least part of the first variable indicia.

9. A method as recited in claim 8 wherein (a)–(n) are practiced so as to produce a second envelope having a surface area at least 20% greater than the first envelope.

10. A method as recited in claim wherein at least one of (b) and (h) is practiced to also image address indicia as part of the variable indicia imaged thereby.

11. A method as recited in claim 10 wherein (a)–(n) are practiced so as to produce a second envelope having a surface area at least 20% greater than the first envelope.

12. A method as recited in claim 1 wherein in practicing (a), (b), (h), and (j), the non-variable indicia is printed using a multi-color flexographic press assembly, and the first variable indicia is practiced using an ink jet printer.

13. A method as recited in claim 1 wherein (a)–(n) are practiced so as to produce a second envelope having a surface area at least 20% greater than the first envelope.

14. A method as recited in claim 1 wherein (f) is practiced to form a flap; and further comprising applying a fourth, cross strip, of adhesive on the second face of the second web at the flap; and wherein (i) is practiced to attach the first envelope to the first face of the third web so that the first envelope flap is visible from the exterior of the second envelope.

15. A method as recited in claim 14 wherein (n) is practiced to form a second flap in the third web; and further comprising applying a gross strip of adhesive on the second face of the third web at the flap.

16. A method as recited in claim 14 wherein (a)–(n) are practiced so as to produce a second envelope having a surface area at least 20% greater than the first envelope.

17. A method as recited in claim 14 wherein in practicing (a), (b), (h), and (j), the non-variable indicia is printed using a multi-color flexographic press assembly, and the first variable indicia is practiced using an ink jet printer.

18. A method as recited in claim 14 wherein (a), (b), (h) and (j) are practiced to image addressee name indicia as at least part of the first variable indicia.

* * * * *